US006382849B1

(12) United States Patent
Sakamoto et al.

(10) Patent No.: US 6,382,849 B1
(45) Date of Patent: May 7, 2002

(54) DEVELOPING METHOD AND DEVELOPING APPARATUS

(75) Inventors: Kazuo Sakamoto; Akira Nishiya, both of Kumamoto (JP)

(73) Assignee: Tokyo Electron Limited, Tokyo (JP)

( * ) Notice: Subject to any disclaimer, the term of this patent is extended or adjusted under 35 U.S.C. 154(b) by 0 days.

(21) Appl. No.: 09/589,169

(22) Filed: Jun. 8, 2000

(30) Foreign Application Priority Data

Jun. 9, 1999 (JP) ..... 11-162563

(51) Int. Cl.[7] ..... G03D 5/00

(52) U.S. Cl. ..... 396/611; 396/627; 427/240; 118/666; 430/311

(58) Field of Search ..... 396/604, 611, 396/627; 134/24, 34, 42, 169 R, 171, 175, 902; 427/240, 299, 336, 385.5; 118/52, 319, 320, 500, 666–668, 712, 716; 430/311

(56) References Cited

U.S. PATENT DOCUMENTS 5,127,362 A * 7/1992 Iwatsu et al. ..... 118/667
5,252,137 A 10/1993 Tateyama et al. ..... 134/34
5,374,312 A * 12/1994 Hasebe et al. ..... 118/52
5,571,560 A * 11/1996 Lin ..... 427/240
5,626,913 A 5/1997 Tomoeda et al. ..... 427/299
5,782,978 A * 7/1998 Kinose et al. ..... 118/319
5,821,035 A * 10/1998 Hirano et al. ..... 430/311
5,919,520 A * 7/1999 Tateyama et al. ..... 427/240
5,962,070 A * 10/1999 Mitsuhashi et al. ..... 427/240
6,066,575 A * 5/2000 Reardon et al. ..... 438/782
6,076,979 A * 6/2000 Mimasaka et al. ..... 396/611
6,089,762 A * 7/2000 Mimasaka et al. ..... 396/611

FOREIGN PATENT DOCUMENTS

JP 2000-133587 A * 5/2000

* cited by examiner

*Primary Examiner*—Russell Adams
*Assistant Examiner*—Arthur A Smith
(74) *Attorney, Agent, or Firm*—Oblon, Spivak, McClelland, Maier & Neustadt, P.C.

(57) ABSTRACT

In a developing processing to apply the developing solution onto the substrate after the light exposure, a developing solution supply nozzle scans a substrate more than once while discharging the developing solution on the substrate in a band shape to coat the substrate with the developing solution. Thus, it is possible to perform a developing processing with a small variation and high uniformity of the line width.

20 Claims, 17 Drawing Sheets

DEVELOPING METHOD AND DEVELOPING APPARATUS

CROSS-REFERENCE TO RELATED APPLICATIONS

This application is based upon and claims the benefit of priority from the prior Japanese Patent Applications No. 11-162563, filed Jun. 9, 1999, the entire contents of which are incorporated herein by reference.

BACKGROUND OF THE INVENTION

The present invention relates to a developing method and a developing apparatus for performing developing processing after exposure to a substrate such as a semiconductor wafer and the like.

In a resist coating and developing processing system for a process of photolithography in the fabricating processes of a semiconductor unit, resist coating processing is performed for forming a resist film on the surface of a semiconductor wafer. Developing processing is performed for developing the wafer after the exposure has been performed for the resist-coated wafer. These resist coating processing and developing processing are respectively performed by a resist coating unit and a developing unit which are included in the above system.

The developing unit comprises a spin chuck for rotating a semiconductor wafer firmly attached on the chuck with vacuum suction and a developing solution supply nozzle for supplying a developing solution onto the semiconductor wafer on the spin chuck. A developing solution supply nozzle used in a conventional developing unit comprises a nozzle body of a hollow rectangular rod shape. The nozzle body has a length longer than the diameter of the semiconductor wafer and a number of developing solution discharge ports formed to be aligned on the bottom surface of the body. In supplying the developing solution onto a semiconductor wafer using such a developing solution supply nozzle, the developing solution supply nozzle is moved to a position to be aligned over the semiconductor wafer diameter of the semiconductor wafer held on the spin chuck. Then, the semiconductor wafer is rotated at least 180° while the developing solution is supplied to the internal space of the developing solution supply nozzle with a predetermined pressure to discharge it onto the semiconductor wafer from the discharge ports. Thereby, a uniform puddle of the developing solution is formed on the entire surface of the semiconductor wafer.

However, when the developing solution is applied as described above, the rotation speed is different between at the central portion of the semiconductor wafer and at the peripheral portion thereof. Since the rotation speed of the central portion is lower than that of the peripheral portion, the supply amount of developing solution at the central is larger than that at the peripheral portion. As a result, the developing processing does not proceed uniformly at the central portion and the peripheral portion on the wafer, whereby the line width of the circuit pattern is susceptible to deteriorating in uniformity.

In order to eliminate such a difference in the amount of the developing solution discharged at the central portion and the peripheral portion of a semiconductor wafer, a scan method in which the developing solution supply nozzle discharges the developing solution while scanning above the semiconductor wafer to thereby apply the developing solution on the semiconductor wafer has been employed more widely. However, in this scan method, since the developing processing does not always proceed uniformly between at the beginning and at the end of the scan, adequate uniformity in the line width of the circuit pattern is not obtained. Moreover, when the developing solution is discharged by such a scan method, the developing solution is supplied outside of the semiconductor wafer as well since the semiconductor wafer is formed in a disc shape, resulting in waste of the developing solution.

BRIEF SUMMARY OF THE INVENTION

It is an object of the present invention to provide a developing method and a developing apparatus to reduce the variation in the developing processing and increase the uniformity of the line width.

It is another object of the invention to provide a developing method and a developing apparatus to reduce the amount of the developing solution unnecessary consumed.

According to the first aspect of this invention, there is provided a developing method for performing a developing processing comprising the steps of moving a developing solution supply nozzle relative to a substrate to scan the substrate with developing solution discharged from the developing solution supply nozzle in a band shape on the substrate after the exposure, and scanning the substrate two or more times with the developing solution from the above developing solution supply nozzle.

According to the second aspect of this invention, there is provided a developing apparatus for performing a developing processing by applying developing solution onto the substrate after the exposure, the apparatus comprising a developing solution supply nozzle configured to discharge the developing solution in a band shape on the substrate, a developing solution supply mechanism configured to provide the developing solution to the developing solution supply nozzle, a motion mechanism configured to move the developing solution supply nozzle relative to the substrate for scanning the substrate with the developing solution discharged from the nozzle, and a control mechanism configured to control the developing solution supply from the developing solution supply mechanism to the developing solution supply nozzle and the relative movement between the nozzle and the substrate so that the developing solution supply nozzle scans the substrate two or more times.

In the first and the second aspects of this invention, since the developing solution supply nozzle scans the substrate two or more times with the developing solution, the paddle formed on the substrate in a first scanning is agitated by the developing solution discharged from the nozzle in a second scanning to allow a uniform developing processing and improve the homogeneity of the line width.

Also, according to the third aspect of this invention, there is provided a developing method for performing a developing processing by applying developing solution onto the substrate subjected to an exposure, the method comprising the steps of forming a plurality of developing solution storage compartments in the developing solution supply nozzle, and applying the developing solution onto the substrate by discharging the solution from the developing solution supply nozzle onto the substrate while controlling the amount of the developing solution discharged from the storage compartments.

According to the fourth aspect of this invention, there is provided a developing apparatus for performing a developing processing by applying developing solution onto a substrate subjected to an exposure, the developing apparatus comprising a developing solution supply nozzle having a number of internal developing solution storage compartments which discharge the developing solution, a motion mechanism configured to create a relative movement between the developing solution supply nozzle and the substrate, a developing solution supply mechanism configured to provide the developing solution to each of the developing solution storage compartments of the developing solution supply nozzle, and a control mechanism configured to control the developing solution supply from the developing solution supply mechanism to the developing solution storage compartments so that a predetermined amount of the developing solution is discharged from each of the developing solution storage compartments of the above developing solution supply nozzle. The developing apparatus supplies the developing solution from the above developing solution supply nozzle to the substrate while creating a relative movement between the above developing solution supply nozzle and the substrate.

In the third and fourth aspects of this invention, the amount of unnecessary consumed developing solution can be decreased since the developing solution supply nozzle is internally divided into a number of developing solution storage compartments and the amount of the developing solution discharged from each compartment is controlled separately when applying the developing solution onto the substrate to decrease or stop the discharge of the developing solution above the area outside of the wafer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Embodiments of the present invention will now be described in detail with reference to the accompanying drawings.

Figure 1:
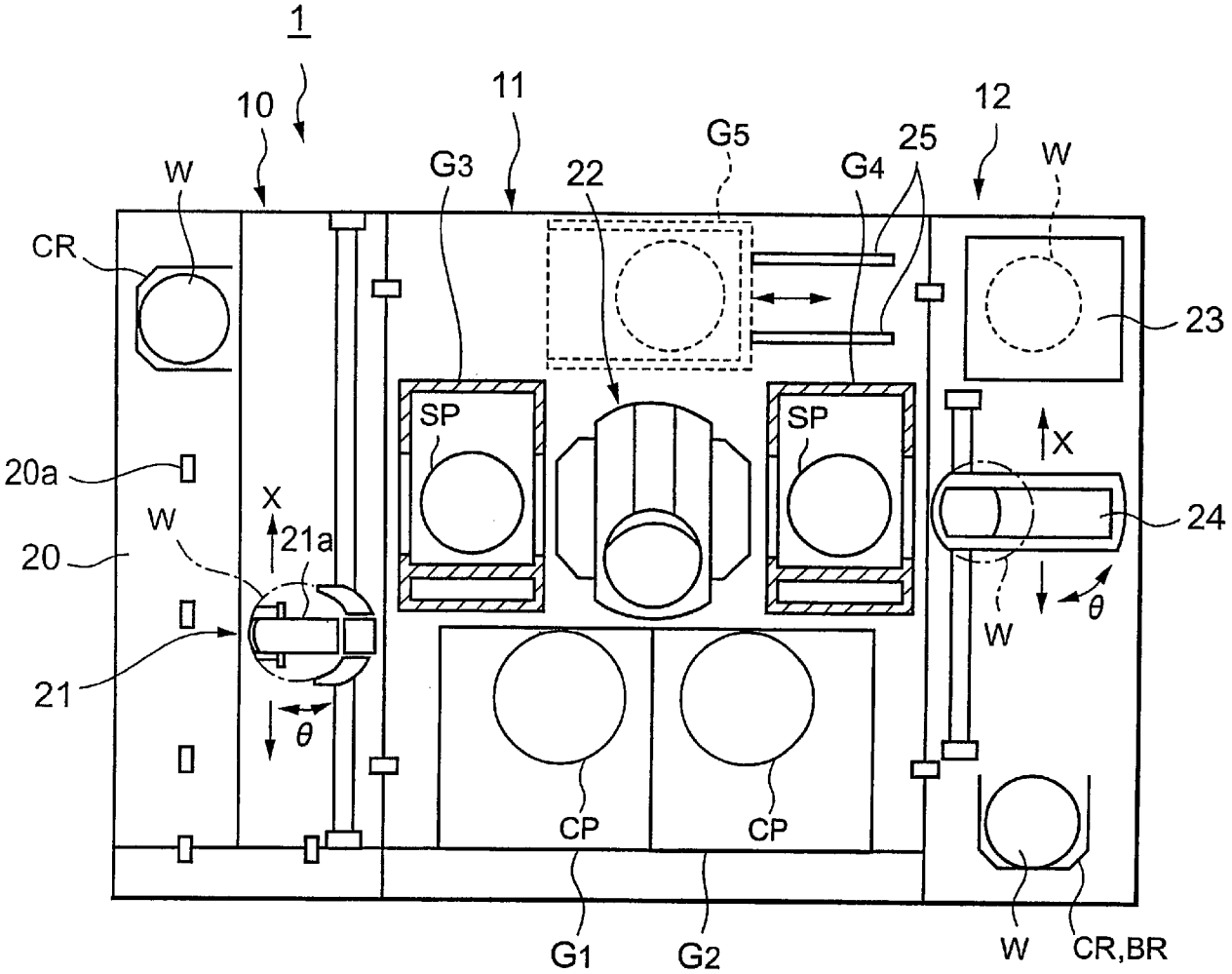
FIG. 1 is a plan view showing the whole structure of a coating and developing processing system for a semiconductor wafer with an integrated developing unit according to an embodiment of the present invention.
Figure 2:
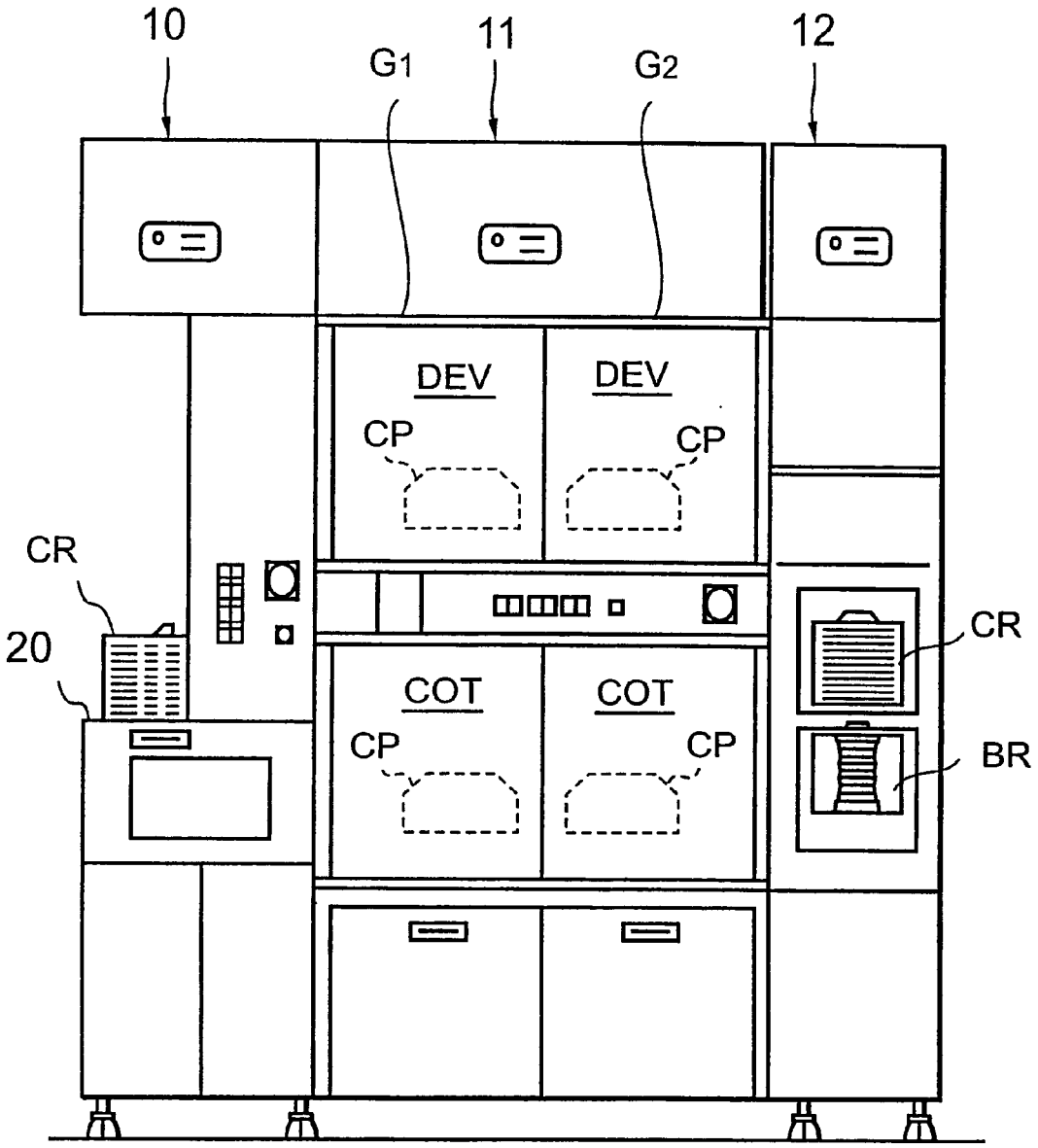
FIG. 2 is a front view showing the whole structure of the coating and developing processing system for a semiconductor wafer with an integrated developing unit according to an embodiment of the present invention.
Figure 3:
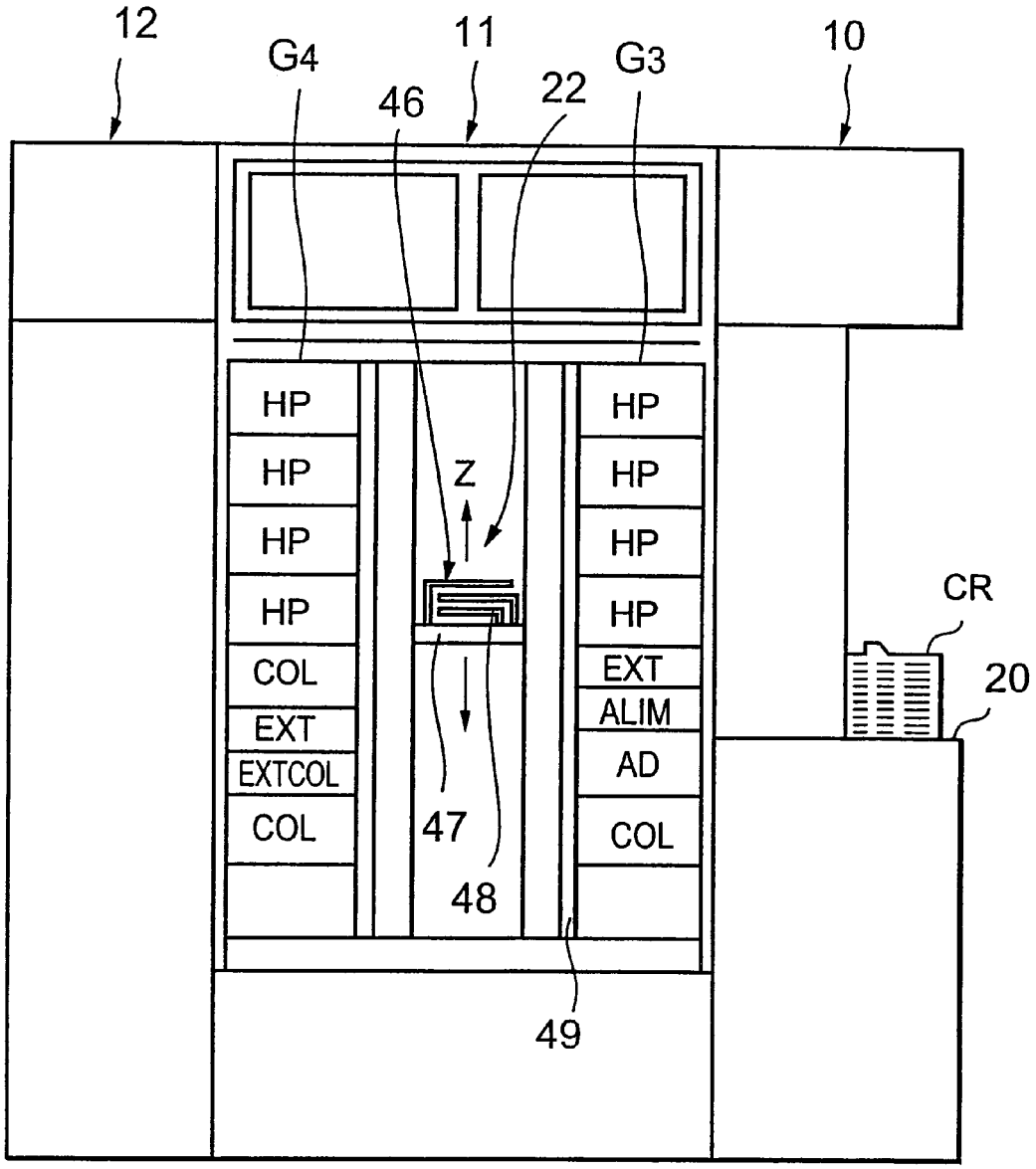
FIG. 3 is a rear view showing the whole structure of the coating and developing processing system for a semiconductor wafer with an integrated developing unit according to an embodiment of the present invention.

FIG. 1 to FIG. 3 are views of a resist coating and developing processing system which includes a developing unit according to the first embodiment of a solution processing apparatus of the present invention. FIGS. 1, 2 and 3 show the schematic plan, the front and the rear thereof respectively.

The resist coating and developing processing system 1 includes a cassette station 10 being a transfer station, a processing station 11 having multiple processing units, and an interface section 12 for delivering the wafer W from and to an aligner (not illustrated) adjacent to the processing station 11.

The cassette station 10 carries a plurality of objects, for example, 25 wafers housed in a wafer cassette CR as a unit from another system into this system or from this system into another system, and transfers the wafer W between the wafer cassette CR and the processing station 11.

In the cassette station 10, as shown in FIG. 1, a plurality of (four in FIG. 1) positioning projections 20*a* are formed on a wafer cassette table 20 along an X-direction in FIG. 1. The wafer cassettes CR can be mounted on the wafer cassette table 20 at positions of the projections 20*a* and in a line with respective wafer transfer ports facing the processing station 11. In the wafer cassette CR, the wafers W are arranged in a vertical direction (a Z-direction). Moreover, the cassette station 10 includes a wafer transfer mechanism 21 positioned between the wafer cassette table 20 and the processing station 11. The wafer transfer mechanism 21 includes a wafer transfer arm 21*a* movable in the direction of arrangement of the cassettes (the X-direction) and in the direction of arrangement of the wafers W housed in the wafer cassette CR (the Z-direction) and can selectively access any of the wafer cassettes CR by the wafer transfer arm 21*a*. The wafer transfer arm 21*a* is also structured to be rotatable in a θ-direction so as to be also accessible to an alignment unit (ALIM) and an extension unit (EXT) included in a third processing unit group $G_3$ on the processing station 11 side which will be described later.

The processing station 11 includes a plurality of processing units for carrying out a series of processes when the developing solution application and development are performed for the wafer W. These units are vertically stacked at predetermined positions, and the wafers W are processed one by one by these units. As shown in FIG. 1, the processing station 11 has a transfer path 22*a* in the middle thereof, a main wafer transfer mechanism 22 is provided in the transfer path 22*a*, and all the processing units are arranged around the wafer transfer path 22*a*. The multiple processing units are divided into a plurality of processing unit groups, and a plurality of processing units are stacked in the vertical direction in each processing unit group.

As shown in FIG. 3, the main wafer transfer mechanism 22 includes a wafer transfer machine 46 which is ascendable and descendable in the vertical direction (the Z-direction) within a cylindrical supporter 49. The cylindrical supporter 49 can rotate by rotational driving force of a motor (not illustrated), and the wafer transfer machine 46 can also rotate integrally with the cylindrical supporter 49.

The wafer transfer machine 46 includes a plurality of holding members 48 which are movable in a forward and rearward direction of a transfer base 47. The delivery of the wafer W between the processing units is performed by these holding members 48.

As shown in FIG. 1, four processing unit groups $G_1$, $G_2$, $G_3$, and $G_4$ are actually arranged around the wafer transfer path 22*a* in this embodiment, and a processing unit group $G_5$ can be disposed as required.

Out of these unit groups, the first and second processing unit groups $G_1$ and $G_2$ are arranged in a row on the front side of the system (on the lower side in FIG. 1), the third processing unit group $G_3$ is arranged adjacent to the cassette station 10, and the fourth processing unit group $G_4$ is arranged adjacent to the interface section 12. Moreover, the fifth processing unit group $G_5$ can be arranged on the rear side.

In the above case, as shown in FIG. 2, in the first processing unit group $G_1$, two spinner-type processing units in which the wafer W is mounted on a spin chuck (not illustrated) inside a cup CP to undergo predetermined processing are vertically stacked. In this embodiment, a resist coating unit (COT) for applying a resist onto the wafer W and a developing unit (DEV) for developing a pattern of the resist are stacked in two stages from the bottom in order. Similarly in the second processing unit group $G_2$, a resist coating unit (COT) and a developing unit (DEV) as two spinner-type processing units are stacked in two stages from the bottom in order.

The resist coating unit (COT) and the like are disposed on the lower stage because drainage of a resist solution is essentially more complex in terms of both mechanism and maintenance than that of a developing solution, and the complexity is mitigated by disposing the resist coating unit (COT) and the like at the lower stage as described above. It is possible, however, to arrange the resist coating unit (COT) and the like at the upper stage as required.

As shown in FIG. 3, in the third processing unit group $G_3$, oven-type processing units in each of which the wafer W is placed on a mounting table SP to undergo predetermined processing are stacked in multi-stages. Namely, a cooling unit (COL) for performing cooling processing, an adhesion unit (AD) for performing so-called hydrophobic processing to enhance adhesive property of the resist, an alignment unit (ALIM) for performing alignment, an extension unit (EXT) for carrying the wafer W in and out, and four hot plate units (HP) for performing heat processing for the wafer W before and after exposure processing and after developing processing are stacked in eight stages from the bottom in order. It is suitable to provide a cooling unit (COL) in place of the alignment unit (ALIM) and to give the cooling unit (COL) an alignment function.

Also, in the fourth processing unit group $G_4$, oven-type processing units are stacked in multi stages. Specifically, a cooling unit (COL), an extension and cooling unit (EXTCOL) which is a wafer carrying in/out section provided with a chill plate, an extension unit (EXT), a cooling unit (COL), and four hot plate units (HP) are stacked in eight stages from the bottom in order.

The cooling unit (COL) and the extension and cooling unit (EXTCOL) having low processing temperature are arranged at the lower stages and the hot plate units (HP) having high processing temperature are arranged at the upper stages, so that mutual interference between units can be reduced. However, these units may be arranged in multi stages in random.

As described above, the fifth processing unit group $G_5$ can be provided on the rear side of the main wafer transfer mechanism 22. In the case where the fifth processing unit group $G_5$ is provided, it can be moved along guide rails 25 laterally when seen from the main wafer transfer mechanism 22. Accordingly, even when the fifth processing unit group $G_5$ is provided, a space portion is secured by sliding the fifth processing unit group $G_5$ along the guide rails 25, so that maintenance operations for the main wafer transfer mechanism 22 can be easily performed from the back thereof. In this case, a space can be secured not only by moving the fifth processing unit group $G_5$ linearly, but also by turning it. Incidentally, one processing unit group basically having a structure in which oven-type processing units are stacked in multi stages likewise with the third and fourth processing unit groups $G_3$ and $G_4$ can be used as the fifth processing unit group $G_5$.

The aforesaid interface section 12 has the same length as the processing station 11 in a depth direction (the X-direction). As shown in FIG. 1 and FIG. 2, a transportable pickup cassette CR and a fixed-type buffer cassette BR are stacked in two stages at the front of the interface section 12, a peripheral aligner 23 is disposed at the rear, and a wafer transfer body 24 is disposed at the center. The wafer transfer body 24 moves in the X-direction and the Z-direction to be accessible to both the cassettes CR and BR, and the peripheral aligner 23. Moreover, the wafer transfer body 24 is rotatable in the θ-direction to be accessible to the extension unit (EXT) included in the fourth processing unit group $G_4$ of the processing station 11 and also to a wafer delivery table (not illustrated) on the adjacent aligner side.

In the resist coating and developing processing system 1 structured as above, the wafer transfer arm 21*a* of the wafer transfer mechanism 21 first accesses to the wafer cassette CR containing unprocessed wafers W on the cassette table 20 and takes one wafer W out of the cassette CR in the cassette station 10 and transfers the wafer W to the extension unit (EXT) of the third processing unit group $G_3$.

The wafer W is transferred from the extension unit (EXT) into the processing station 11 by means of the wafer transfer machine 46 of the main wafer transfer mechanism 22. Then, the wafer W is aligned in the alignment unit (ALIM) of the third processing unit group $G_3$ and thereafter transferred to the adhesion unit (AD) to undergo hydrophobic processing (HMDS processing) for enhancing adhesive property of the resist. Since this processing involves heating, the wafer W is then transferred to the cooling unit (COL) by the wafer transfer machine 46 and cooled.

Cooled in the cooling unit (COL) after the completion of the adhesion processing, the wafer W is subsequently transferred to the resist coating unit (COT) by the wafer transfer machine 46, where a coating film is formed. After the completion of the coating processing, the wafer W undergoes prebake processing in any one of the hot plate units (HP) of the processing unit groups $G_3$ and $G_4$ and is cooled in any one of the cooling units (COL).

The cooled wafer W is transferred to the alignment unit (ALIM) of the third processing unit group $G_3$ and aligned there, and thereafter the wafer W is transferred to the interface section 12 via the extension unit (EXT) of the fourth processing unit group $G_4$.

In the interface section 12, peripheral exposure is performed for the wafer W by the peripheral aligner 23 to remove the excess resist, and the wafer W is transferred to the aligner (not illustrated) provided adjacent to the interface section 12, where the resist film of the wafer W undergoes exposure processing in accordance with a predetermined pattern.

The exposed wafer W is returned again to the interface section 12 and transferred to the extension unit (EXT) included in the fourth processing unit group $G_4$ by the wafer transfer body 24. The wafer W is transferred to any one of the hot plate units (HP) by the wafer transfer machine 46 to undergo post-exposure bake processing and then cooled by the cooling unit (COL).

The wafer W is then transferred to the developing unit (DEV), where the exposed pattern is developed. After the completion of the developing, the wafer W is transferred to any one of the hot plate units (HP) to undergo postbake processing and then cooled by the cooling unit (COL). After the completion of such a series of processing, the wafer W is returned to the cassette station 10 via the extension unit (EXT) of the third processing unit group $G_3$ and housed in any of the wafer cassettes CR.

Figure 4:
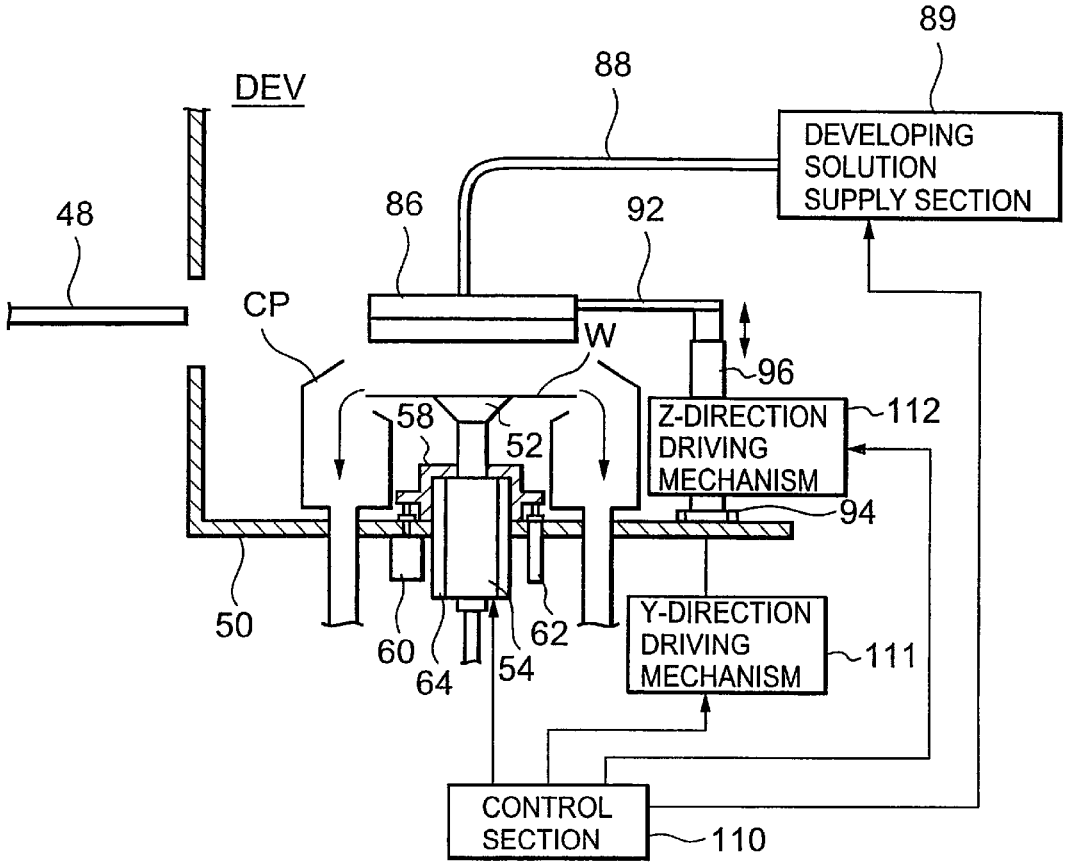
FIG. 4 is a cross-sectional view showing the whole structure of a developing unit according to the first embodiment of the present invention.
Figure 5:
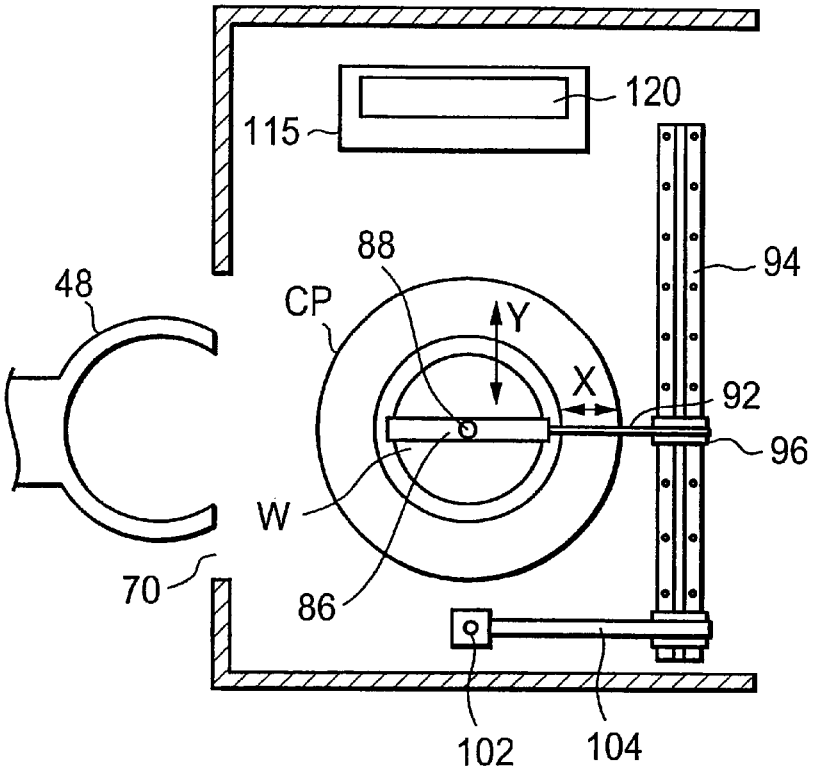
FIG. 5 is a plan view showing the developing unit according to the first embodiment of the present invention.

Next, the developing unit (DEV) according to the first embodiment of the present invention will be explained with reference to FIG. 4 and FIG. 5. FIG. 4 is a schematic cross-sectional view of the developing unit (DEV) and FIG. 5 is a schematic plan view of the developing unit (DEV) shown in FIG. 4.

A cylindrical cup CP is disposed in the center section of this developing unit (DEV) and a spin chuck 52 is disposed in the inside of the cup CP. The spin chuck 52 is rotated by a driving motor 54 with the wafer W firmly attached by vacuum suction. The driving motor 54 is disposed at the opening of a unit basal plate 50 so that the motor is ascendable and descendable in the vertical direction. The driving motor 54 is integrated with, for example, an ascending/descending drive unit 60 and an ascending/descending guide unit 62 comprising an air cylinder through, for example, a cap-shaped flange member 58. A cylindrical cooling jacket 64 is installed on the side of the driving motor 54 made of, for example, stainless steel (SUS) and the flange member 58 is installed so that it covers the upper half of the cooling jacket 64.

When applying the developing solution, the lower end of this flange member 58 is tightly attached to the unit basal plate 50 near the opening of the unit basal plate 50 and tightly close the unit. When the wafer W is passed between the spin chuck 52 and the main wafer transfer mechanism 22, the ascending/descending drive unit 60 elevates the lower end of the flange member 58 from the unit basal plate 50 by shifting the driving motor 54 or the spin chuck 52 to the upper direction. Incidentally, the body of the developing unit (DEV) has a window 70, through which the wafer holding members 48 are inserted.

The developing solution supply nozzle 86 to apply the developing solution onto the surface of the wafer W has a rectangular rod shape, whose longitudinal direction is arranged to be horizontal, and is connected to the developing solution supply section 89 through the developing solution supply tube 88. The developing solution supply nozzle is installed at the end section of the nozzle scan arm 92 and is removable. This scan arm 92 is installed on the vertical holding members 96, which is movable in the horizontal direction along the guide rails 94 laid on the unit basal plate 50 in one direction (the Y-direction), and is movable in the Y-direction together with the vertical holding members 96 as a whole by a Y-direction driving mechanism 111. Also, the developing solution supply nozzle 86 is ascendable and descendable in the vertical direction ( the Z-direction) by the Z-direction driving mechanism 112.

Figure 6:
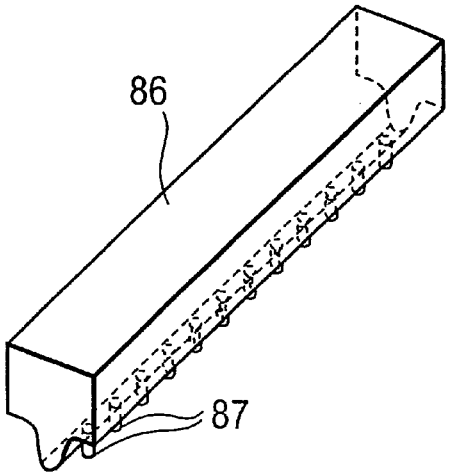
FIG. 6 is a perspective view showing a developing solution supply nozzle used for the developing unit according to the first embodiment of the present invention.

The developing solution supply nozzle 86 has a plurality of discharge ports 87 as shown in FIG. 6 and the discharged developing solution forms a band shape as a whole. When applying the developing solution, the developing solution supply nozzle 86 discharges the developing solution onto the wafer W in a band shape while moving along the guide rails 65 by the Y-direction driving mechanism 112 to scan the wafer W with the developing solution. In the present embodiment, the developing solution supply nozzle 86 is designed to move reciprocally in order to scan the wafer W more than once. Incidentally, since the developing solution supply nozzle 86 moves reciprocally while discharging the developing solution, it is structured to discharge the developing solution onto the wafer W vertically so that the developing solution can be discharged onto the wafer W from both scan directions.

The movement of the developing unit (DEV) is controlled by the control section 110. More specifically, the driving motor 54, the Y-direction driving mechanism 111 and the Z-direction driving mechanism 112 are driven by the control section 110. Also, the developing solution supply from the developing solution supply section 89 is controlled by the control section 110. In the present embodiment, when applying the developing solution, the developing solution supply from the developing solution supply section 89 is controlled so that the developing solution is discharged from the developing solution supply nozzle 86 while the movement of the Y-direction driving mechanism 111 is controlled so that the scan is performed more than once by the developing solution supply nozzle 86.

The developing unit (DEV) has a rinse nozzle 102 to discharge the cleaning fluid. This rinse nozzle 102 is installed at the end of the nozzle scan arm 104, which is movable in the Y-direction along the guide rails 94. Thus, this rinse nozzle discharges the cleaning fluid on the wafer W by moving above the wafer W after the developing processing with the developing solution is completed.

The developing solution supply nozzle 86 is designed to be moved into the nozzle standby section 115 and this nozzle standby section 115 has a nozzle cleaning mechanism 120 to clean the nozzle 86.

Next, the developing processing in the developing unit (DEV) structured as above will be explained.

After exposed with a predetermined pattern and undergone the post-exposure bake process and the cooling process, the wafer W is transferred to exactly above the cup CP by the main wafer transfer mechanism 22 and firmly attached by vacuum suction to the spin chuck 52 elevated by the ascending/descending drive unit 60.

Figure 7A:
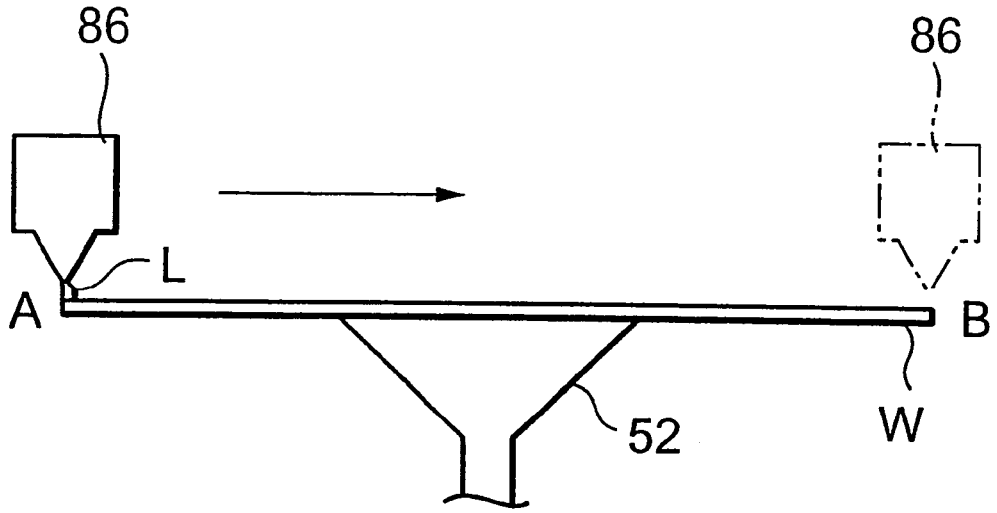
FIGS. 7A and 7B are schematic diagrams explaining a developing solution discharge method according to the first embodiment of the present invention.
Figure 7B:
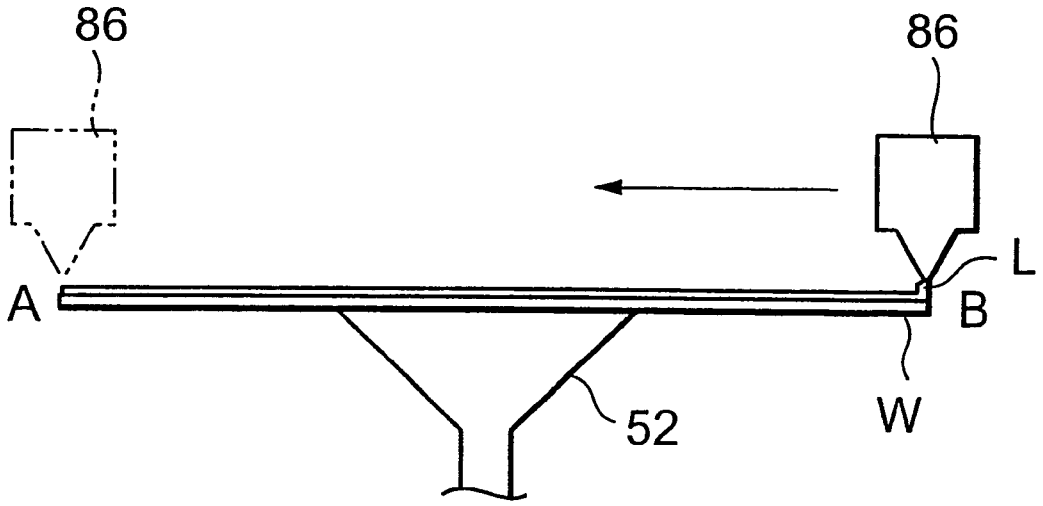

Next, as shown in FIG. 7A, the developing solution supply nozzle 86 is positioned above one end section A of the wafer W, then, the developing solution supply nozzle 86 discharges the developing solution L in a band shape while moving to the other end section B of the wafer W by the Y-direction driving mechanism 111 to complete the first scan. Next, as shown in FIG. 7B, the developing solution supply nozzle 86 discharges the developing solution L in a band shape while moving from the end section B to the end section A of the wafer W by the Y-direction driving mechanism 111 to complete the second scan. By performing the aforementioned reciprocating motion predetermined times, the developing solution supply nozzle 86 scans predetermined times, which is more than once, to form a puddle of the developing solution. Thus, the developing solution discharged by the developing solution supply nozzle 86 from the second scan on creates an effect to agitate the developing solution puddle on the wafer W and this agitation effect improves the uniformity of the line with by allowing a uniform developing process.

In this case, it is possible to use the control section 110 to either decrease the amount of developing solution discharged from the developing solution supply nozzle 86 or stop the discharge for a certain time period during the scan. Thus, the uniformity of the line width can be improved while decreasing the discharge amount of the developing solution.

Also, it is possible to control the driving motor 54 by the control section 10 to rotate the wafer W by predetermined angle (30–60°; for example, 30° during the second scan and another 30° during the third scan). Thus, the uniformity of the line width can be improved by distributing the developing solution more uniformly on the wafer W.

After applying the developing solution as above, the wafer W is left to stand for a predetermined time period for the developing processing to progress by the natural convection. After this time period, the wafer W is rotated by the spin chuck 52 to remove the developing solution by the centrifugal force, then, the rinse nozzle 102 is moved to above the wafer W and the cleaning fluid is discharged from the rinse nozzle 102 to rinse off the developing solution on the wafer W.

Then, the spin chuck 52 is rotated at a high speed and the remaining developing solution and cleaning fluid are removed by the centrifugal force to dry the wafer W. Thus, a series of developing processes is completed.

Then, the developing solution supply nozzle 86 to which the developing solution is attached in the developing solution agitation process is moved to the nozzle standby section 115 and positioned in the nozzle cleaning mechanism (the nozzle bath) 120, where the cleaning fluid is discharged at the end of the developing solution supply nozzle 86 to clean it.

Next, results from the actual development according to the present embodiment will be explained. Here, the developing solution was applied to the wafer W by discharging the developing solution from the developing solution supply nozzle 86 shown in the above-mentioned FIG. 6, while moving the developing solution supply nozzle with the Y-direction driving mechanism 111 to scan the wafer W a plurality of times with the discharged developing solution.

More specifically, the following procedures were employed.

First, the developing solution supply nozzle 86 is positioned 5 mm away from the rim of the wafer W in the radial direction and dummy discharge of the developing solution was performed by the developing solution supply nozzle 86 at the rate of 0.68–2.0 litter/minutes for 0.5 second.

After this dummy discharge, the developing solution supply nozzle 86 was moved by the Y-direction driving mechanism 111 to scan above the wafer W. The traveling speed at this time was 25–150 mm/second.

After this first scan, the developing solution supply nozzle 86 performs the second scan for the wafer by the Y-direction driving mechanism 111. Then, in a similar manner, the developing solution supply nozzle 86 performs the scan three to four times.

After these scans, the developing solution supply nozzle 86 is moved 5 mm away from the rim of the wafer W in the radial direction for performing the dummy discharge for 0.5 second and, after ceasing the discharge, moved to the nozzle cleaning mechanism (the nozzle bath) 120.

Figure 8:
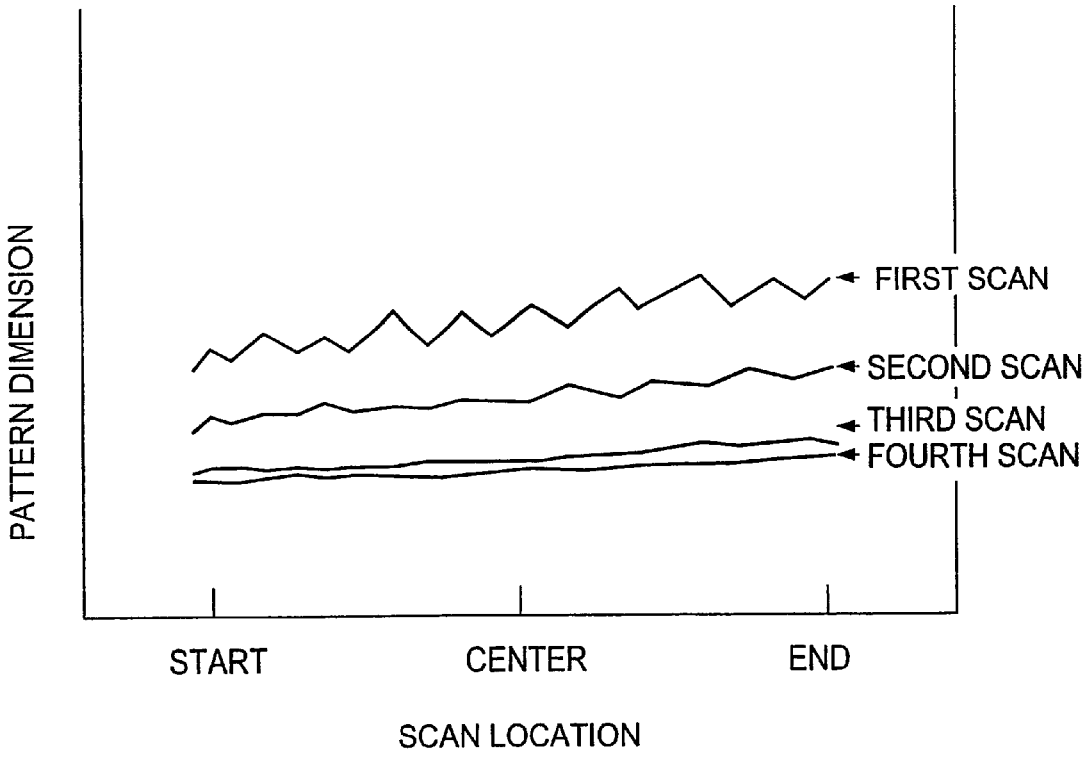
FIG. 8 is a graph showing the relationship between the position of the developing solution supply nozzle above the wafer during the scan and the pattern dimension according to the number of scans performed.

The experiment results are presented in FIG. 8. FIG. 8 shows the relationship between the position of the developing solution supply nozzle above the wafer during the scan and the pattern dimension (i.e., line width) according to the number of scans performed. As apparent from FIG. 8, in the first scan, the variation and the overall difference between the start and the end positions were seen in the pattern dimension on the wafer surface. However, the variation and the difference diminish as the number of scans increases. Thus, the variation in the line width can be decreased to improve the line width uniformity by scanning more than once and also by increasing the number of scans.

Figure 9:
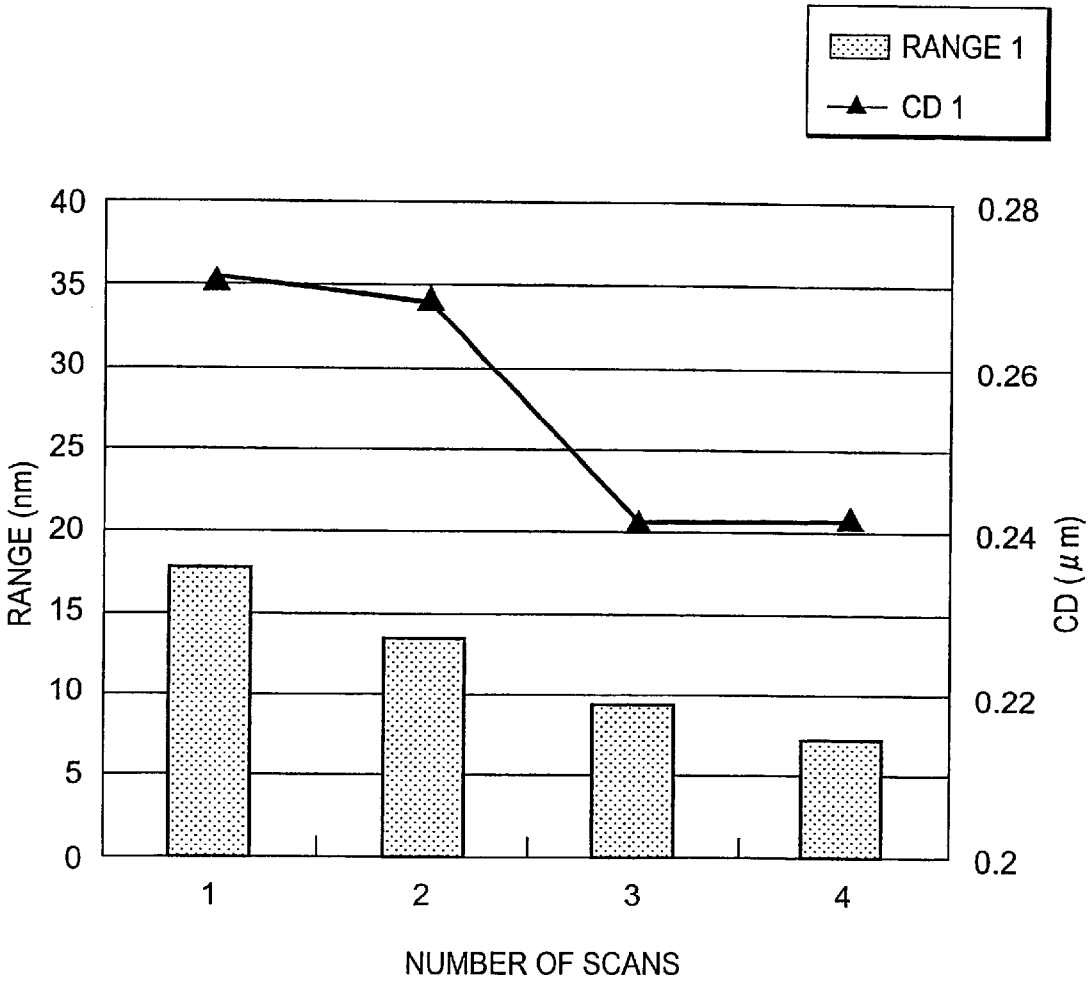
FIG. 9 is a graph showing the relationships between the number of scans performed by the developing solution supply nozzle and the in-plane range of the line width, and between the number of scans and the critical dimension (CD)

Other experiment results are presented in FIG. 9. FIG. 9 shows the relationships between the number of scans and the in-plane range of the line width, and between the number of scans and the critical dimension (CD). As apparent from FIG. 9, the in-plane range of the line width (Range/nm) decreases as the number of scans increases. It is verified that the in-plane range becomes small enough to cause only few problems for practical purposes after the fourth scan. Also, it is verified that the critical dimension significantly decreases to become small enough to cause only few problems for practical purposes as the number of scans increases, especially from the third scan on.

Figure 10A:
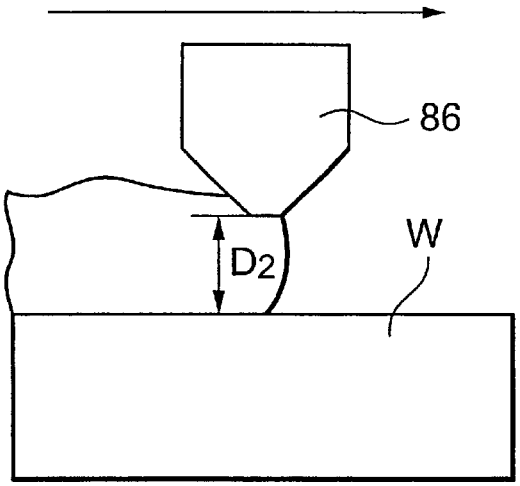
FIGS. 10A and 10B are schematic plan views showing the first modified movement of a developing solution supply nozzle in the above embodiment.
Figure 10B:
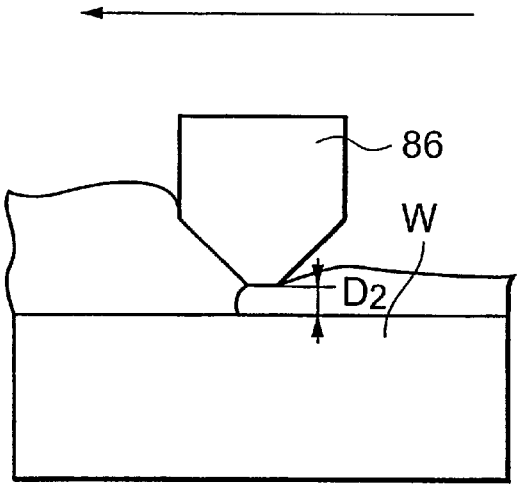

Incidentally, in the above-mentioned embodiment, as shown in FIGS. 10A and 10B, the distance D2 between the developing solution supply nozzle 86 and the wafer W from the second scan on (for example, about 0.5 mm) can be smaller than that of the first scan (for example, about 1.5 mm) by adjusting the height of the developing solution supply nozzle 86. Thus, the agitation effect of the developing solution puddle on the wafer W can be enhanced from the second scan on.

Figure 11A:
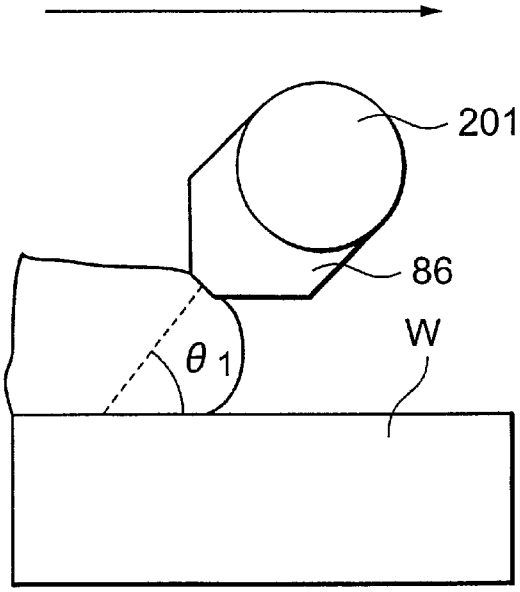
FIGS. 11A and 11B are schematic plan views showing the second modified movement of a developing solution supply nozzle in the above embodiment.
Figure 11B:
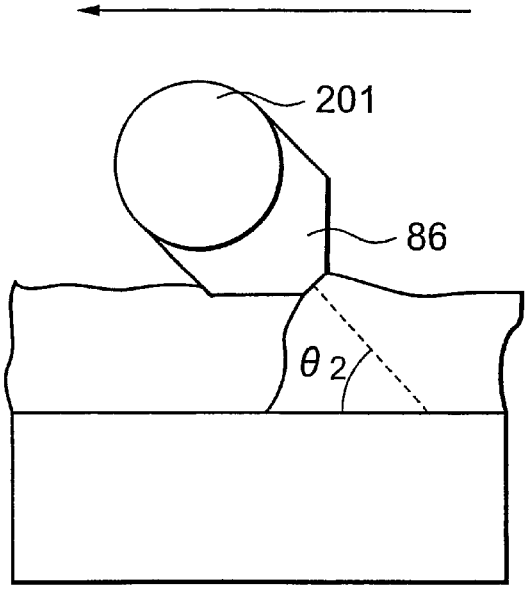

Also, as shown in FIGS. 11A and 11B, the angle between the developing solution supply nozzle 86 and the surface of the wafer W can be changed by rotating the developing solution supply nozzle 86 with a rotation mechanism 201. For example, as shown in FIG. 11A, the angle θ1 between the developing solution supply nozzle 86 and the surface of the wafer W for the first scan can be about 45° with respect to the traveling direction of the developing solution supply nozzle 86. As shown in FIG. 11B, the angle θ2 between the developing solution supply nozzle 86 and the surface of the wafer W for the second scan can be about 45° with respect to the traveling direction of the developing solution supply nozzle 86. This also enhances the agitation effect of the developing solution by the developing solution supply nozzle 86.

Figure 12:
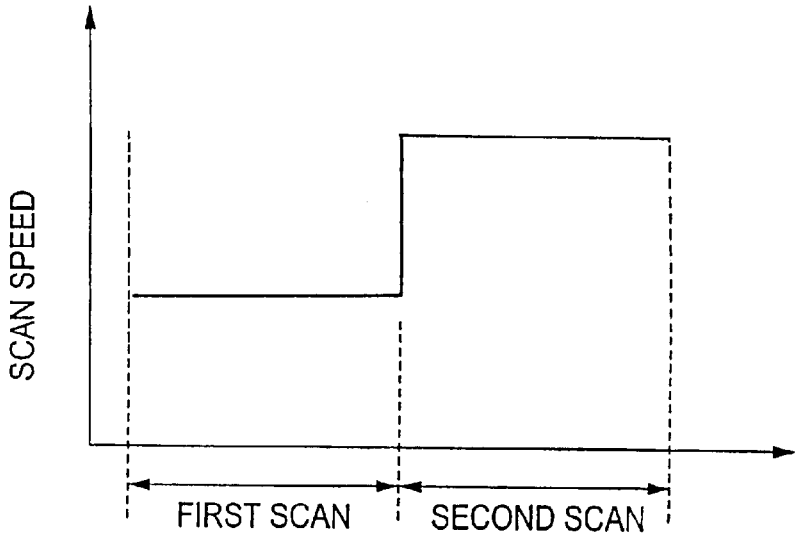
FIG. 12 is a diagram showing a relation between a scanning speed and a scanning time.

Furthermore, as shown in FIG. 12, the traveling speed of the developing solution supply nozzle 86 may be higher in the second scan than the first scan. If scans are performed three or more times, it is desirable to further increase the scan speed from the third scan onwards.

Figure 13:
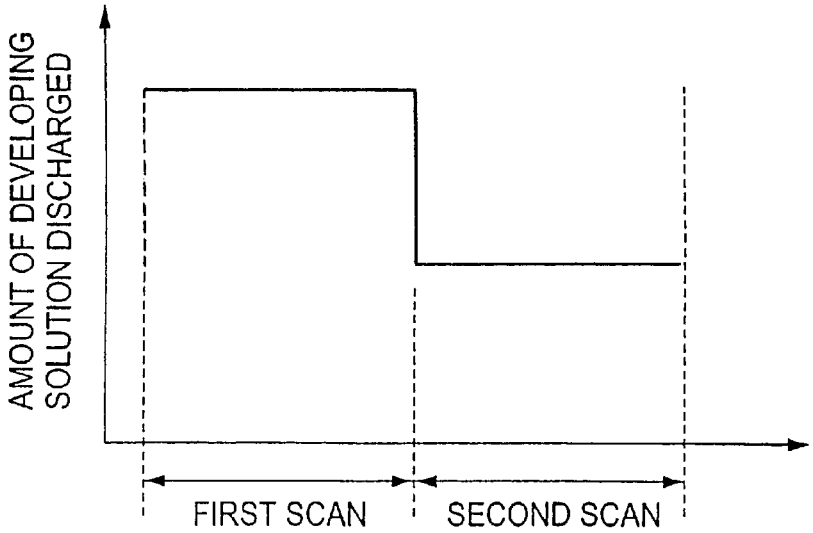
FIG. 13 is a diagram showing a relation between an amount of discharging developing solution and a scanning time.

Also, as shown in FIG. 13, the amount of the developing solution discharge from the second scan can be smaller than that of the first scan. This also enhances the agitation effect of the developing solution by the developing solution supply nozzle 86. If scans are performed three or more times, it is desirable to further decrease the discharge amount from the third scan onwards.

Figure 14:
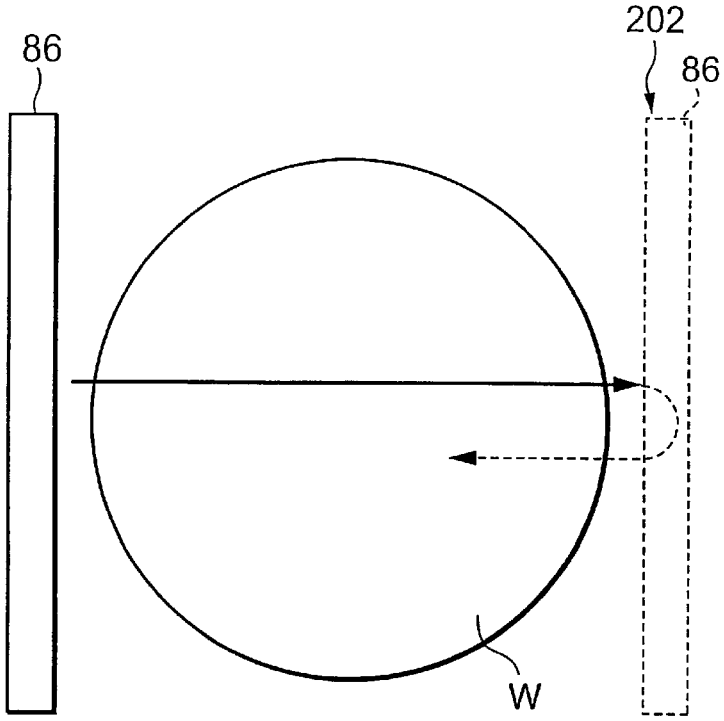
FIG. 14 is a schematic plan view showing the fifth modified movement of a developing solution supply nozzle in the above embodiment.

Also, as shown in FIG. 14, after the first scan by the developing solution supply nozzle 86, the nozzle can pause at the position 202, which is above outside of the wafer W, for two to three seconds, for example, before starting the second scan. Since it is highly possible that dripping of the developing solution from the developing solution supply nozzle 86, if any, occurs during this pausing time period outside of the wafer surface, the damage to the wafer W due to this dripping can be prevented.

Figure 15:
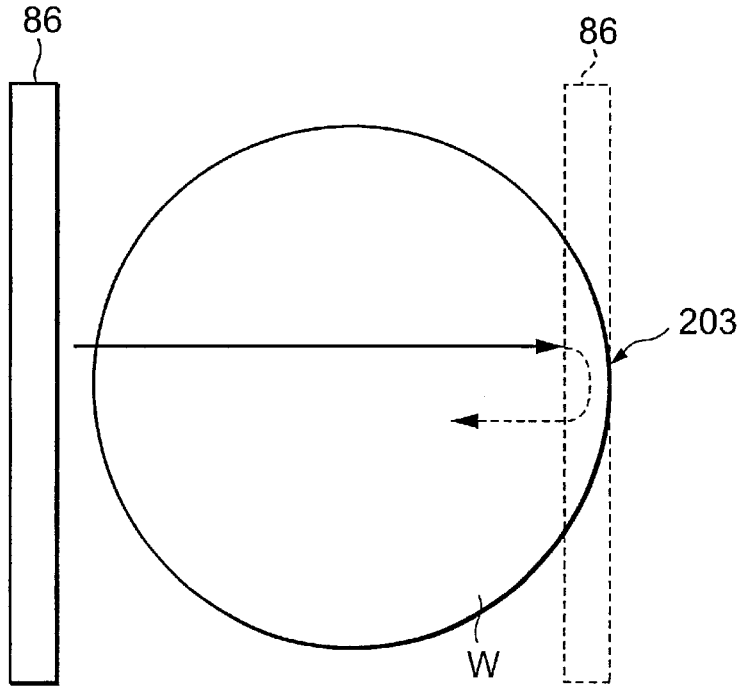
FIG. 15 is a schematic plan view showing the sixth modified movement of a developing solution supply nozzle in the above embodiment.

Moreover, as shown in FIG. 15, if the developing solution supply nozzle 86 turns back to start the second scan in the opposite direction without pausing when it reaches the end section 203 of the wafer W, the developing solution supply nozzle 86 can continuously discharge the developing solution. Thus, the solution drip can be prevented.

Figure 16:
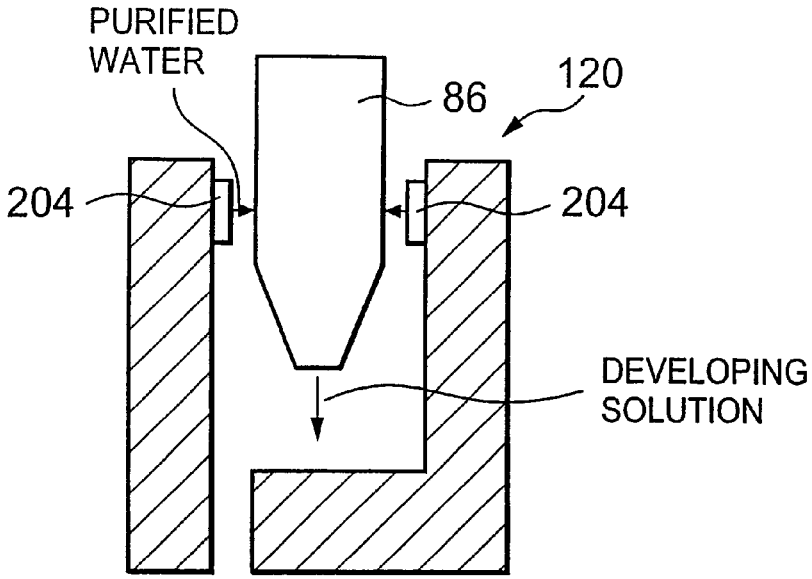
FIG. 16 is a cross-sectional view showing an example of a cleaning mechanism of a developing solution supply nozzle in the above embodiment.

Also, as shown in FIG. 16, the nozzle cleaning mechanism 120 can have a cleaning fluid spurting mechanism 204 to spurt the cleaning fluid, for example, purified water at the developing solution supply nozzle 86 while the developing solution supply nozzle 86 discharges the developing solution. Thus, it is possible to thoroughly remove dissolution products and prevent the cleaning fluid from entering the developing solution supply nozzle 86.

Figure 17:
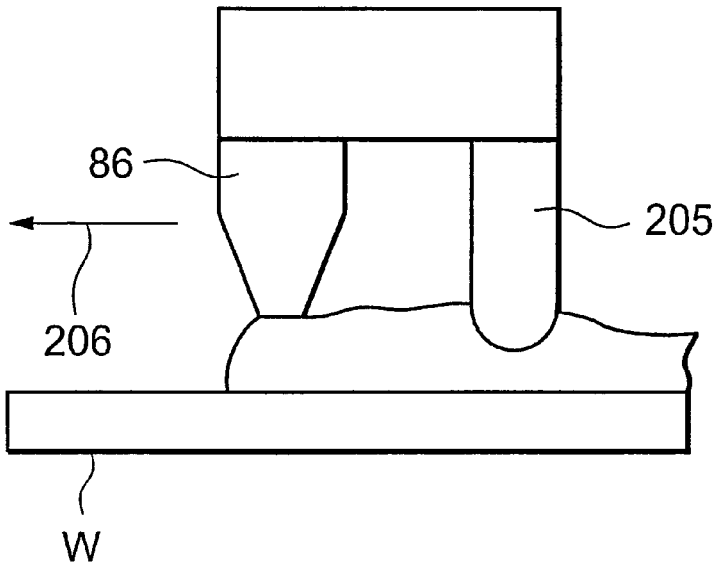
FIG. 17 is a schematic plan view showing a modified example of a developing solution supply nozzle in the above embodiment.

Furthermore, as shown in FIG. 17, a heater 205 can be integrated behind the developing solution supply nozzle 86 in respect to its traveling direction with a predetermined distance from the nozzle. Thus, the heat from the heater will cause convection in the developing solution puddle on the wafer W to mix the dissolution products in the puddle and improve the uniformity of the development process.

Also, back rinse may be performed at the same time from the second scan on.

Next, a developing unit (DEV) according to the second embodiment will be described.

Figure 18:
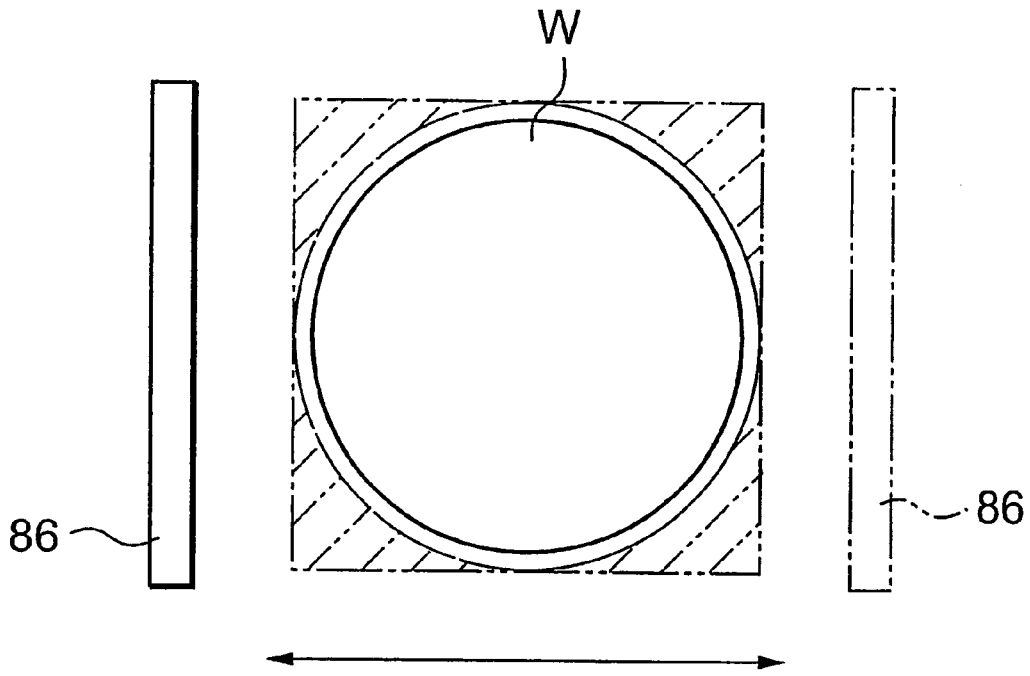
FIG. 18 is a schematic diagram showing the top view of a developing unit which scans while discharging the developing solution from the developing solution supply nozzle.
Figure 19:
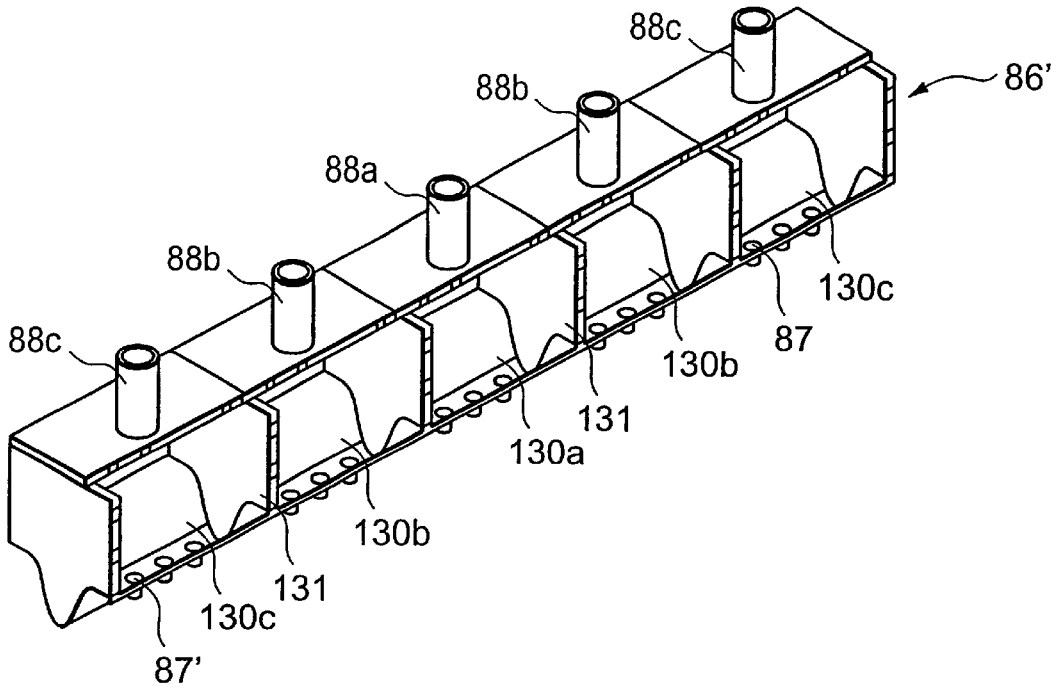
FIG. 19 is a partial cross-sectional perspective view showing part of a developing solution supply nozzle according to the second embodiment of the present invention.
Figure 20:
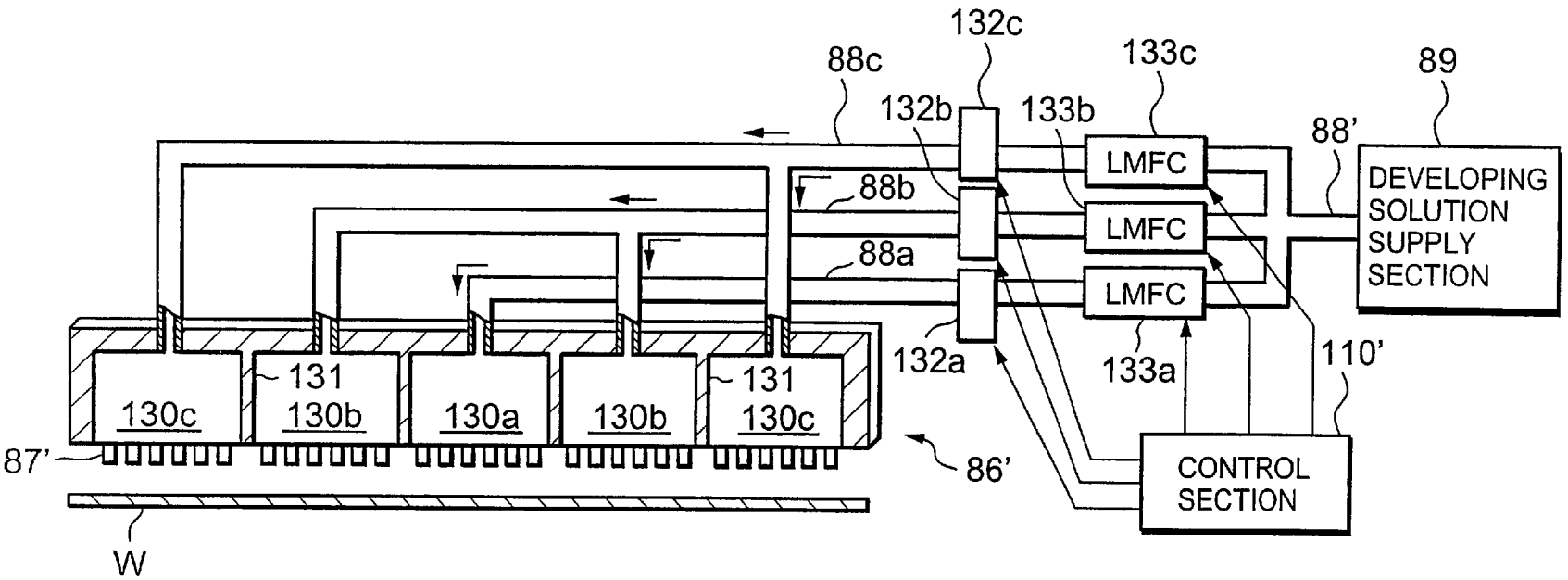
FIG. 20 is a partial cross-sectional view showing a developing solution supply nozzle and a discharge mechanism according to the second embodiment of the present invention.

As shown in FIG. 18, when scanning while discharging the developing solution from the developing solution supply nozzle 86 in a band shape, the developing solution discharged outside of the wafer W (the shaded area in FIG. 18) will be wasted. Therefore, in this embodiment, as shown in FIG. 19 and FIG. 20, a developing solution supply nozzle 86' is employed. The developing solution supply nozzle 86' is internally divided by a plurality of partition walls 131 to have a plurality of developing solution storage compartments 130*a*, 130*b* and 130*c* and discharges the developing solution through a plurality of discharge ports 87'. The developing solution storage compartment 130*a* is located in the center among these development solution storage compartments of the developing solution supply nozzle 86' and there are two development solution storage compartments 130*b* on both sides of 130*a*. Furthermore, there are two development solution storage compartments 130*c* on the outer side of each 130*b*. The developing solution storage compartments 130*a*, 130*b* and 130*c* are called the first, the second and the third zones, respectively.

Each zone is connected to piping for developing solution supply. Namely, the first developing solution supply tube 88*a*, the second developing solution supply tubes 88*b* and the third developing solution supply tubes 88*c* are connected to the first, the second and the third zones, respectively. Also, the first to the third developing solution supply tubes 88*a*–88*c* have valves for tube opening and closing 132*a*–132*c* comprising, for example, valves operated with air, and flux control units 133*a*–133*c* comprising, for example, liquid mass flow controller (LMFC), respectively. These flux control valves 132*a*–132*c* and flux control units 133*a*–133*c* are controlled by the control section 110'. These developing solution supply tubes 88*a*–88*c* merge into one supply tube 88' to be connected with the developing solution supply section 89 at the upstream of the flux control units 133*a*–133*c*.

When the developing solution supply nozzle 86' structured as above scans over the wafer W while discharging the developing solution in a band shape, part of the nozzle 86' discharges the developing solution outside of the wafer W at the beginning of the scan. For conventional developing solution supply nozzles, the developing solution discharged outside of the wafer W is wasted.

Figure 21A:
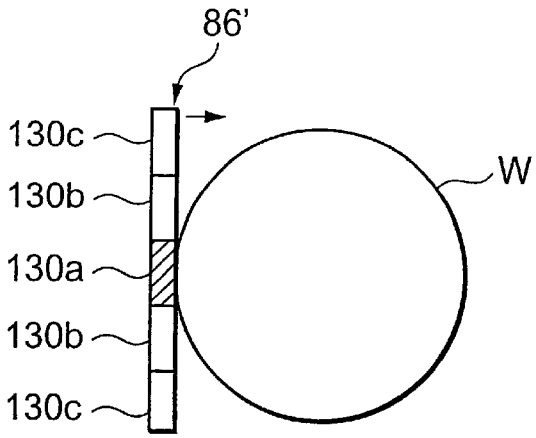
FIGS. 21A to 21C are diagrams explaining a developing solution discharge method according to the second embodiment of the present invention.
Figure 21B:
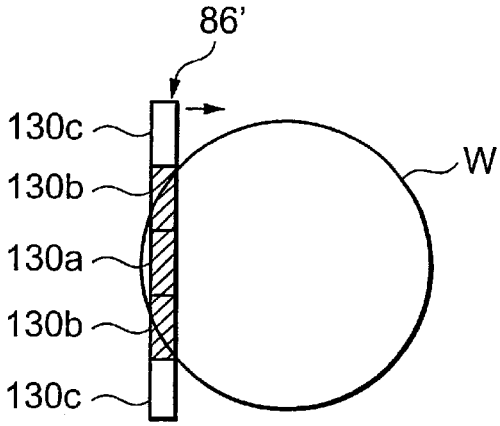
Figure 21C:
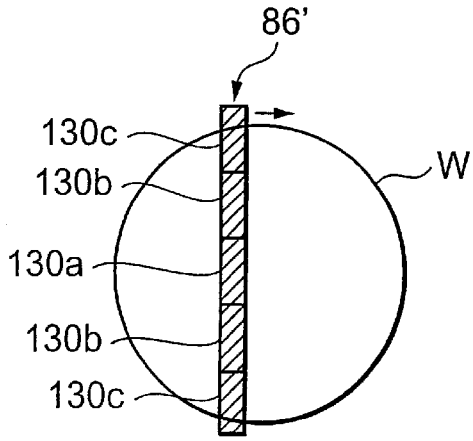

However, in the present embodiment, the control section 110' controls the flux control valve or the flux control unit to reduce or stop the supply of the development solution into the developing solution storage compartment of the zone corresponding to the nozzle part which is not above the wafer W. More specifically, since the second and the third zones are outside of the wafer W immediately after starting the scan, as shown in FIG. 21A, the flux control valves 132*b* and 132*c* are closed or the flux control unit 133*b* and 133*c* are controlled to stop or reduce the discharge amount of the developing solution from the developing solution storage compartments 130*b* and 130*c*, corresponding to the second and the third zones, respectively by the control section 110' so that the normal amount of the developing solution is discharged only from the developing solution storage compartment 130*a* corresponding to the first zone. When only the third zone is outside of the wafer W as the scan proceeds, as shown in FIG. 21B, the discharge amount of the developing solution from the developing solution storage compartment 130*b,* corresponding to the second zone, becomes normal and the discharge amount from the compartment 130*c,* corresponding to the third zone, is still stopped or reduced. When the third zone is also above the wafer W as the scan proceeds further, as shown in FIG. 21C, all the developing solution storage compartments discharge the normal amount of the developing solution. As the scan proceeds furthermore, first the third zone, then, the second zone become outside of the wafer W. In these cases, similar to the above-mentioned manner, the discharge amount of the developing solution from the developing solution storage compartment 130*c* of the third zone and/or the compartment 130*b* of the second zone can be paused or reduced.

Thus, the developing solution supply nozzle 86' with a plurality of developing solution storage compartments 130*a*–130*c,* which are divided into a plurality of zones, can reduce the overall usage of the developing solution by decreasing the unnecessary usage of the development solution.

In this second embodiment, the number of the developing solution storage compartments and the number of the zones are not restricted. The accuracy of the control improves if theses numbers increase. Also, the uniformity of the line width improves while reducing the consumption of the developing solution if the developing solution supply nozzle 86' with a plurality of developing solution storage compartments is used for two or more scans in a manner similar to that according to the first embodiment.

Figure 22:
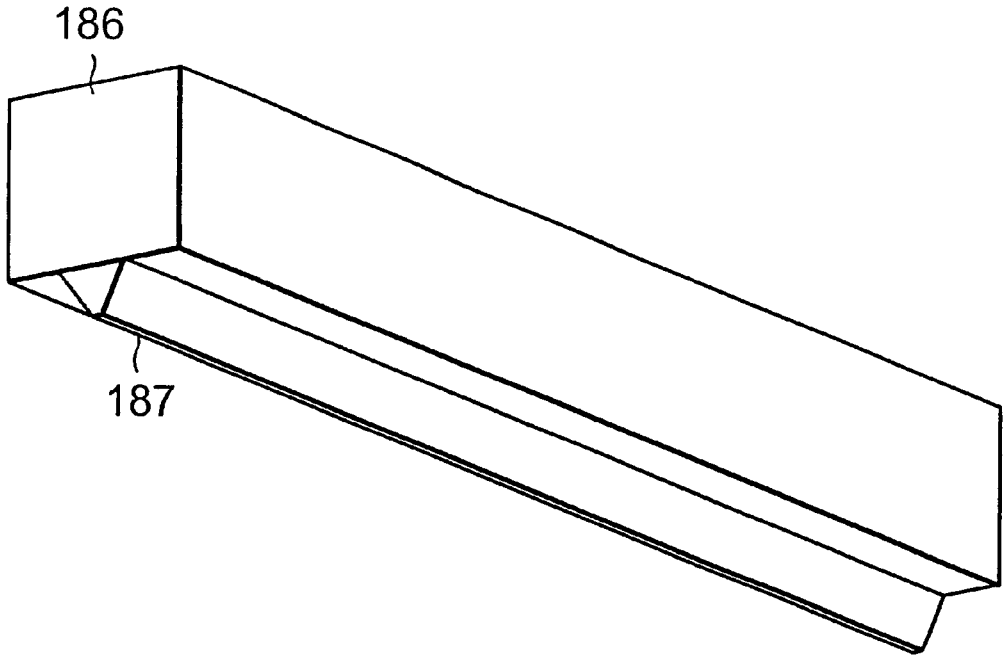
FIG. 22 is a perspective view of another example of a developing solution supply nozzle.

Incidentally, embodiments of the present invention are not limited to the above two and various modifications are possible. For example, the design of a developing solution supply nozzle is not limited to the above and it is possible to use designs such as the one shown in FIG. 22, which has a developing solution supply nozzle with a slit-shaped developing solution discharge port 187.

Also, although the developing solution supply nozzle scans the substrate in the above embodiment, it is possible to move the substrate instead of the developing solution supply nozzle to create the similar condition in which the developing nozzle scans as a result. Furthermore, the developing unit integrated to the coating and developing processing system for semiconductor wafers described above may be a stand-alone unit and may be used for substrates other than semiconductor wafers by applying the present invention to developing apparatuses for, for example, LCD substrates.

The effect of the present invention, as explained above, is the improvement of the uniformity of both the developing processing and the line width achieved by applying the developing solution onto the substrate with scanning motion more than once to agitate the developing solution puddle on the substrate, created by the first scan, by the developing solution discharge from the second scan onwards.

Also, overall usage of the developing solution can be reduced since it is possible to decrease the unnecessary usage of the development solution by internally dividing the developing solution storage compartment and controlling the discharge amount of the developing solution from each subdivided storage compartment separately while discharging the development solution on the substrate to reduce or stop the supply of the developing solution to the section where the discharge of the developing solution is unnecessary, for example, outside of the substrate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing method for performing a developing processing by applying a developing solution onto a substrate after exposure, comprising the steps of:

(a) creating a relative movement between a developing solution supply nozzle and the substrate so that the developing solution supply nozzle scans the substrate from one end side to the other end side while the developing solution supply nozzle discharges the developing solution in a band shape;

(b) creating a relative movement between the developing solution supply nozzle and the substrate after said step (a) so that the developing solution supply nozzle scans the substrate; and (c) changing an amount of the developing solution discharged from the developing solution supply nozzle so that an amount of the developing solution discharged from the developing solution supply nozzle in said step (b) is smaller than the amount of the developing solution discharged from the developing solution supply nozzle in said step (a).

2. The method according to claim 1, wherein the developing solution supply nozzle moves reciprocally above the substrate by the relative movement between the developing solution supply nozzle and the substrate in said step (a) and the relative movement between the developing solution supply nozzle and the substrate in said step (b).

3. The method according to claim 1, wherein a discharge amount of the developing solution from the developing solution supply nozzle is reduced in said step (b).

4. The method according to claim 1, wherein the developing solution is not discharged from the developing solution supply nozzle in said step (b).

5. The method according to claim 1, further comprising the step of:

rotating the substrate by a predetermined angle between said step (a) and said step (b).

6. The method according to claim 1, further comprising the step of:

ascending/descending at least either one of the developing solution supply nozzle and the substrate so that a distance between the developing solution supply nozzle and the substrate in said step (b) is smaller than a distance between the developing solution supply nozzle and the substrate in said step (a).

7. The method according to claim 1, further comprising the step of:

rotating at least either one of the developing solution supply nozzle and the substrate so that an angle formed between the developing solution supply nozzle and the substrate in said step (b) is different from an angle formed between the developing solution supply nozzle and the substrate in said step (a).

8. The method according to claim 1, further comprising the step of:

changing a moving speed of at least either one of the developing solution supply nozzle and the substrate so that a velocity of relative motion between the developing solution supply nozzle and the substrate in said step (b) is higher than a velocity of relative motion between the developing solution supply nozzle and the substrate in said step (a).

9. The method according to claim 1, further comprising the step of:

suspending the movement of the developing solution supply nozzle between said step (a) and said step (b).

10. The method according to claim 9, wherein the suspending period of time of the developing solution supply nozzle is at least 2 seconds.

11. The method according to claim 1, further comprising the step of:

cleaning the developing solution supply nozzle by spraying a cleaning solution at the developing solution supply nozzle while the developing solution supply nozzle discharges the developing solution.

12. A developing apparatus for performing a developing processing by applying a developing solution onto a substrate after exposure processing, comprising:

a developing solution supply nozzle configured to discharge the developing solution in a band shape onto the substrate;

a developing solution supply mechanism configured to supply the developing solution to said developing solution supply nozzle;

a motion mechanism configured to create a relative movement between said developing solution supply nozzle and the substrate so that said developing solution supply nozzle scans above the substrate;

a control mechanism configured to control supply of the developing solution from said developing solution supply mechanism to said developing solution supply nozzle and the relative movement by said motion mechanism so that said developing solution supply nozzle scans the substrate more than once while discharging the developing solution in a band shape; and a cleaning mechanism configured to clean said developing solution supply nozzle by spraying a cleaning solution at said developing solution supply nozzle while said developing solution supply nozzle discharges the developing solution.

13. The apparatus according to claim 12, wherein said motion mechanism is configured to create a relative reciprocating movement between said developing solution supply nozzle and the substrate.

14. The apparatus according to claim 12, wherein said control mechanism is configured to control said developing solution supply mechanism so that a discharge amount of the developing solution is decreased to be smaller than that of the preceding discharge or the developing solution is not discharged during scanning after the second scan.

15. The apparatus according to claim 12, further comprising:

a rotation mechanism configured to rotate the substrate, wherein said control mechanism is configured to control said rotation mechanism so that, when said developing solution supply nozzle scans the substrate more than once while discharging the developing solution in a band shape onto the substrate, the substrate is rotated by a predetermined angle before a scan is started at the time of scanning after the second scan.

16. The apparatus according to claim 12, further comprising:

a heating mechanism configured to move together with said developing solution supply nozzle so that heat is applied to the developing solution discharged in a band shape from said developing solution supply nozzle.

17. A developing apparatus for performing a developing processing by applying a developing solution onto a substrate after exposure processing, comprising:

a developing solution supply nozzle having an inside divided into a plurality of developing solution storage compartments each storing the developing solution, for discharging the developing solution from these developing solution storage compartments;

a motion mechanism configured to create a relative movement between said developing solution supply nozzle and the substrate;

a developing solution supply mechanism configured to separately supply the developing solution to each of the plurality of developing solution storage compartments of said developing solution supply nozzle;

a control mechanism configured to separately control the amount of the developing solution supplied to each of the developing solution storage compartments from said developing solution supply mechanism so that predetermined amounts of the developing solution are separately discharged from the plurality of developing solution storage compartments of said developing solution supply nozzle, wherein the developing solution is supplied from said developing solution supply nozzle onto the substrate while a relative movement is created between said developing solution supply nozzle and the substrate by said motion mechanism; and a cleaning mechanism configured to clean said developing solution supply nozzle by spraying a cleaning solution at said developing solution supply nozzle while said developing solution supply nozzle discharges the developing solution.

18. The apparatus according to claim 17, wherein said motion mechanism is configured to create a relative movement between said developing solution supply nozzle and the substrate so that said developing solution supply nozzle scans above the substrate.

19. The apparatus according to claim 17, wherein said control mechanism controls the amount of the developing solution supplied to each of the developing solution storage compartments from said developing solution supply mechanism so that the discharge amount of the developing solution from any developing solution storage compartment which is placed at a position away from the substrate is decreased or the developing solution is not discharged therefrom when said developing solution supply nozzle scans above the substrate.

20. The apparatus according to claim 17, wherein said control mechanism is configured to control the supply of the developing solution from said developing solution supply mechanism to each developing solution storage compartment and the relative movement created by said motion mechanism so that said developing solution supply nozzle scans above the substrate more than once in a band shape while said developing solution supply nozzle discharges the developing solution in a band shape.

* * * * *